US005595864A

United States Patent [19]

Van den Zegel et al.

[11] Patent Number: 5,595,864

[45] Date of Patent: Jan. 21, 1997

[54] METHOD FOR MAKING TABULAR SILVER HALIDE GRAINS

[75] Inventors: Marc Van den Zegel, Boortmeerbeek; Marcel Mestdagh, Rymenam, both of Belgium

[73] Assignee: Agfa-Gevaert, N.V., Mortsel, Belgium

[21] Appl. No.: 274,363

[22] Filed: Jul. 13, 1994

Related U.S. Application Data

[63] Continuation of Ser. No. 48,429, Apr. 20, 1993, abandoned.

[30] Foreign Application Priority Data

May 5, 1992 [EP] European Pat. Off. ..... 92201259

[51] Int. Cl.[6] ..... G03C 1/015

[52] U.S. Cl. ..... 430/569; 430/966

[58] Field of Search ..... 430/567, 569, 430/966

[56] References Cited

FOREIGN PATENT DOCUMENTS 9118320 11/1991 WIPO .

*Primary Examiner*—Janet C. Baxter

*Attorney, Agent, or Firm*—Breiner & Breiner

[57] ABSTRACT

A photographic material has been coated on at least one side of a support with in at least one photosensitive layer hexagonal and/or circular tabular silver halide emulsion crystals occupying at least 70% of the total projected area of all grains, having a thickness of 0.15 to 0.30 μm, a coefficient of variation of the tabular grains between 0.15 and 0.45 and an average aspect ratio of at least 2:1, prepared in the absence of ammonia by growing the nuclei, prepared at a pBr value between 1.0 and 2.0 and consuming less than 10% by weight of silver nitrate, during a first growth step at a pBr value between 1.0 and 2.5 consuming at least 10% by weight of silver nitrate and during a second growth step at a pBr value higher than 2.7 during the addition of at least 40% of the total amount of silver nitrate used. The loss in sensitivity and gradation after development of said material in a diluted cheap developer after exposing said photographic material containing said emulsion grains is neglectable in comparison with the characteristics obtained after development in stronger high quality developers.

11 Claims, No Drawings

METHOD FOR MAKING TABULAR SILVER HALIDE GRAINS

This is a continuation of application Ser. No. 08/048,429 filed on Apr. 20, 1993, now abandoned.

FIELD OF THE INVENTION

This invention relates to a method of making tabular silver halide grains of intermediate thickness (0.15 to 0.30 μm), useful in forehardened coated radiographic materials.

BACKGROUND OF THE INVENTION

Tabular silver halide grains are crystals possessing two parallel faces with a ratio between the diameter of a circle having the same area as these faces, and the thickness, being the distance between the two major faces, equal to two or more.

Tabular grains are known in the photographic art for quite some time. As early as 1961 Berry et al described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes Bogg U.S. Pat. No. 4,063,951, Lewis U.S. Pat. No. 4,067,739 and Maternaghan U.S. Pat. Nos. 4,150,994; 4,184,877 and 4,184,878. However the tabular grains described herein cannot be regarded as showing a high diameter to thickness ratio, commonly termed aspect ratio. In a number of US Patent Applications filed in 1981 and issued in 1984 tabular grains with high aspect ratio and their advantages in photographic applications are described. So Wilgus U.S. Pat. No. 4,434,226 discloses tabular silver bromoiodide grains having a thickness less than 0.2 μm, a diameter of at least 0.6 μm and an average aspect ratio greater than 8:1 and accounting for at least 50 percent of the total projected area of all the emulsion grains. Kofron U.S. Pat. No. 4,439,520 discloses similar grains which are spectrally sensitized. Abbott U.S. Pat. No. 4,425,425 describes radiographic materials containing tabular grains with an aspect ratio of at least 8:1 and Abbott U.S. Pat. No. 4,425,426 discloses similar grains with an aspect ratio between 5:1 and 8:1. A survey on high aspect ratio silver halide emulsions appeared in Research Disclosure, Volume 225, Jan 1983, Item 22534.

For radiographic applications the main photographic advantages of tabular grains compared to normal globular grains are a high covering power at high forehardening levels, a high developability and higher sharpness especially in double side coated spectrally sensitized materials. The thinner the tabular grains the greater these advantages.

In spite of these important advantages, tabular grains have two important disadvantages. These grains are highly susceptible to mechanical stress and the developed silver has an unacceptable reddish-brown colour compaired with the cold-black colour shown by more globular grains.

This reddish-brown colour can be corrected by increasing the optical density in the red region of the visible spectrum by adding suitable dyes to the undercoat layer, to the emulsion layer and/or to the protective layer. But this inevitably leads to an undesirable higher gross-fog of the photographic material and obviously the sensitivity to mechanical stress is not improved by this optical correction method.

A more convenient way to overcome these two disadvantages is to use tabular grains with an increased thickness. Methods to prepare these thicker tabular grains have already been described in U.S. Pat. Nos. 4,801,522; 5,028,521 and 5,013,641 but all these methods make use of ammonia or generate ammonia "in situ". Yet, methods using the volatile ammonia are difficult to control and are more susceptible to fog generation during the emulsion preparation.

OBJECTS OF THE INVENTION

Therefore it is an object of this invention to precipitate tabular grains having a thickness larger than 0.15 μm and thus overcoming the above disadvantages of unacceptable image tone and susceptibility to mechanical stress, without making use of ammonia. A further object is to retain the favourable developability as thin tabular grains.

Other objects will become apparent from the description hereinafter.

SUMMARY OF THE INVENTION

In accordance with the present invention a method is provided for the preparation of an emulsion with tabular silver halide grains, wherein at least 70% of the total projected area of all the grains is provided by said tabular grains, and wherein said tabular grains exhibit an average aspect ratio of at least 2:1 an average thickness between 0.15 and 0.30 μm, a coefficient of variation of the tabular grains between 0.15 and 0.45 said method comprising the following steps:

preparing a dispersion medium containing a gelatino-peptizer and being adjusted to a pBr value between 1.0 and 2.0 by means of a bromide ions providing salt a crystal nucleation step consuming less than 10% by weight of the total amount of silver nitrate used a first double jet crystal growth step wherein at least 10% of the total amount of silver nitrate is precipitated at a constant pBr value between 1.0 and 2.5, and a second double jet crystal growth step wherein at least 40% of the total amount of the silver nitrate used is added at a constant pBr value higher than 2.7.

It has been found that the tabular grains of this invention are showing an unexpectedly good developability even compared to tabular grains with lower thickness in cheap, more diluted developing chemistry having less than 20 g and even less than 15 g of hydroquinone per litre.

DETAILED DESCRIPTION OF THE INVENTION

Of the total amount of silver nitrate less than 10% by weight preferably 0.5% to 5.0% is added during the nucleation step which consists preferably of an approximately equimolecular simultaneous addition of silver nitrate and halide salts at a pBr of 1.0 to 2.0. The rest of the silver nitrate and halide salts is added during consecutive double jet growth steps. The different steps of the precipitation can be alternated by physical ripening steps or by so called "neutralization steps", during which the pAg value is changed to a value required in the next growth stage by adding an amount of silver nitrate solution or a water soluble halide salt within a well-defined time of addition by means of the single-jet technique. Alternative ways to regulate the pAg to the desired value before continuing the processing are diluting the emulsion present in the reaction vessel, diafiltration or ultrafiltration and even flocculation and washing procedures, the last techniques being preferred to concentrate the emulsion crystals in the reaction vessel. Any combination or any choice of the mentioned techniques may be applied thereto.

At least two growth steps are necessary. In the first growth step the crystal grows laterally and in the second growth step a simultaneous growth in the direction perpendicular to the main planes is induced. The ratio of the second growth step to the first growth step and the pBr in this second growth step is such that the average thickness is between 0.15–0.30 μm preferably between 0.20 and 0.30 μm. The average aspect ratio is then preferably less than 8, even less than 5. During the growth step(s) an increasing flow rate of silver and halide solutions is preferably applied, e.g. a linearly increasing flow rate. Typically the flow rate at the end is about 3 to 10 times greater then at the start of the growth step. For the succesful preparation of the present invention the pBr before the start and during the different stages of the precipitation is maintained at a well-defined value as will become apparent from the examples hereinafter.

After completion of the precipitation a wash technique in order to remove the excess of soluble salts may be applied at a pH value which can vary during washing but remains comprised between 4.0 and 7.0. If in that case the emulsion is washed by diafiltration by means of a semipermeable membrane this technique is also called ultrafiltration. Such procedures are disclosed e.g. in Research Disclosure Vol. 102, Oct. 1972, Item 10208, Research Disclosure Vol. 131, March, Item 13122 and Mignot U.S. Pat. No. 4,334,012. Preferably, at the start of the ultrafiltration, pH and pAg are the same as at the end of the precipitation without any adjustment. Besides these previously mentioned dialysis techniques like ultrafiltration flocculation by polymeric reagents at a pH value below 4.0, followed by redispersion may be applied.

It is specifically contemplated that up to 3 mole percent of iodide ions can be incorporated in the silver halide e.g. silver bromide tabular grains of the present invention. This can be achieved by mixing a soluble bromide and a soluble iodide salt in one or more of the halide solutions up to the desired mole % concentrations required in each preparation step or by a triple jet technique, or separate addition of an iodide containing aqueous solution. Due to the lower solubility of iodide ions in comparison with bromide ions, said iodide ions are able to displace bromide ions from the grain, a technique known in the art as conversion. Iodide ions may also be incorporated into the silver halide crystal lattice by the addition of a previously prepared silver iodide micrate emulsion, composed of either pure silver iodide or mixed halides.

Two or more types of tabular silver halide emulsions that have been prepared differently can be mixed for forming a photographic emulsion for use in accordance with the present invention.

The size distribution of the tabular silver halide particles of the photographic emulsions to be used according to the present invention can be monodisperse or heterodisperse. The tabular grain emulsion becomes more heterodisperse by adding more silver nitrate during the first growth step at a pBr value lower than 1.7, said value being preferably lower than 1.2.

In this way low contrast heterodisperse emulsions with a coefficient of variation of the tabular grains between 0.20–0.45, even between 0.30–0.45 can be obtained.

The tabular silver halide emulsions in connection with the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions may be sensitized also by means of gold-sulphur ripenets or by means of reductors e.g. tin compounds as described in GB Patent 789,823, amines, hydrazine derivatives, formamidine-sulphinic acids, and silane compounds.

The tabular silver halide emulsions may be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful exeunples in connection with tabular grains is given in the already cited Research Disclosure Item 22534. Especially preferred green sensitizer in connection with the present invention are anhydro-5,5'-dichloro-3,3'-bis(n.sulfobutyl)-9-ethyloxacarbo-cyanine hydroxide and anhydro-5,5'-dichloro-3,3'-bis(n.sulfopropyl)-9-ethyloxacarbo-cyanine hydroxide.

In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains. This may also be done with the emulsions of the present invention, wherein the chemical sensitization proceeds in the presence of one or more phenidone and derivatives, a dihydroxy benzene as hydroquinone, resorcinol, catechol and/or a derivative(s) therefrom, one or more stabilizer(s) or antifoggant(s), one or more spectal sensitizer(s) or combinations of said ingredients. Especially 1-p-carboxyphenyl, 4,4'dimethyl-3-pyrazolidine-1-one may be added as a preferred auxiliary agent.

The silver halide emulsion layer(s) in accordance with the present invention or the non-light-sensitive layers may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure N° 17643 (1978), Chapter VI. Many of these fog-inhibiting compounds may have been already added during the chemical ripening of the tabular silver halide crystals.

In the preparation of emulsions according to the present invention there is no need for the use of a special oxidized gelatin or the presence of a synthetic peptizer. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Before and during the formation of the silver halide grains it is common practice to establish a gelatin concentration of from about 0.05% to 5.0% by weight in the dispersion medium. Additional gelatin is added in a later stage of the emulsion preparation, e.g. after washing, to establish optimal coating conditions and/or to establish the required thickness of the coated emulsion layer. Preferably a gelatin/silver halide ratio ranging from 0.3 to 1.0 is then obtained.

The gelatin binder of the photographic elements can be forehardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EU Patent Application 408,143.

The photographic tabular grains in connection with the present invention can be used in various types of photographic elements, e.g. black and white silver halide photographic materials, like materials used for X-ray diagnostic purposes, or colour sensitive materials.

The photographic element may contain one single emulsion layer, as it is the case for many applications, or it can be built up by two or even more emulsion layers. In X-ray photography a material with a single or a duplitized emulsion layer coated on one or both sides of the support may contain silver halide emulsions according to the invention. By using duplitized emulsions differing in photographic speed by at least 0.15 log E a gain in cross-over exposure in double side coated materials can be obtained. In the case of color photography the material contains blue, green and red sensitive layers each of which can be single coated, but merely consist of double or even triple layers. Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes etc.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g. higher contrast, sensitization, and development acceleration. Preferred surface-active coating agents are compounds containing perfluorinated alkyl groups.

Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805–4,038,075 and 4,292,400.

The photographic element of the present invention may further comprise various other additives such as e.g. compounds improving the dimensional stability of the photographic element, UV-absorbers, spacing agents and plasticizers.

Suitable additives for improving the dimensional stability of the photographic element are e.g. dispersions of a water-soluble or hardly soluble synthetic polymer e.g. polymers of alkyl(meth) acrylates, alkoxy(meth) acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth) acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455. UV-absorbers are especially useful in colour materials where they prevent the fading by light of the colour images formed after processing.

Spacing agents can be present of which, in general, the average particle size is comprised between 0.2 and 10 μm.

Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The photographic material can contain several non-light sensitive layers, e.g. an antistress topcoat layer, one or more backing layers, and one or more intermediate layers eventually containing filter- or antihalation dyes that absorb scattering light and thus promote the image sharpness. Suitable light-absorbing dyes used in these intermediate layers are described in e.g. U.S. Pat. Nos. 4,092,168, U.S. Pat. No. 4,311,787, DE 2,453,217, and GB Patent 7,907,440. Situated in such an intermediate layer between the emulsion layers and the support there will be only a small negligable loss in sensitivity but in rapid processing conditions decolouration of the filter dye layers may form a problem. Therefor it should be recommended to decrease the thickness of the whole coated layer packet resulting in shorter drying times after washing in the processing cycle. Alternatively the use of intermediate layers situated between emulsion layer(s) and support, reflecting the fluorescent light emitted by the screens may bring a solution. As the light emitted from the screens by the phosphors incorporated therein is a very important source of light-scattering the addition of appropriate filter dyes to the screens may be recommended. In the presence in the screens of e.g. green light-emitting phosphors use may be made of specific dyes as MAKROLEX ORANGE G or GG, trademarked products of BAYER AG.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene terephthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example, in a preferred embodiment of materials for X-ray diagnostic purposes said materials may be adapted to rapid processing conditions. Preferably an automatically operating processing apparatus is used provided with a system for automatic regeneration of the processing solutions. The forehardened material may be processed using one-part package chemistry or three-part package chemistry, depending on the processing application determining the degree of hardening required in said processing cycle. Applications within total processing times of 30 seconds and lower up to 90 seconds, known as common praxis, are possible. From an ecological point of view it is even possible to use sodium thiosulphate instead of ammonium thiosulphate.

The following examples illustrate the invention without however limiting it thereto.

EXAMPLES

All tabular grains were precipitated using the double jet technique with control of the pAg value, said value being defined as the negative logarithm of the silver ion concentration.

After precipitation, every example was analysed using shadowed carbon replicas obtained with an electron microscope. For each example a minimum of hundred grains were measured and the following characteristics were then calculated:

- the number of tabular grains were calculated, a tabular grain being defined as a grain with two parallel main planes and a ratio between the diameter, and the thickness of the grains of at least 2, with
- the diameter being the diameter of a circle having an equivalent projective surface area of the grain and
- the thickness being the distance between the main planes of the flat tabular crystals A characterization of the crystal population of an emulsion was given by

- average diameter size: calculated as the average by number from the diameters of the tabular grains.
- coefficient of variation of the tabular grains: calculated as the ratio between the standard deviation of the average diameter and the average diameter
- average thickness: calculated as the average by number from the distance between the main planes measured for all crystals
- aspect ratio: as the ratio between the mean calculated diameter and the mean calculated thickness defined hereinbefore
- percentage of the total projective surface: part of the total projective area covered by the tabular grains in percentage.

For all examples three solutions were used during the precipitation:

- Solution 1:1 1.5 liter of an aqueous solution containing 500 grams of silver nitrate.
- Solution 2: 1.5 liter of an aqueous solution containing 350 grams of potassium bromide.
- Solution 3: 1.5 liter of an aqueous solution containing 341 grams of potassium bromide and 12.2 grams of potassium iodide.

EXAMPLE 1

Emulsion 1 (comparative tabular emulsion):

Nucleation step:

41.3 ml of solutions 1 and 2 were introduced into a reaction vessel in 28 seconds using the double jet technique. Said reaction vessel initially contained 2.16 liter of destilled water at 45° C., 12.6 grams of potassium bromide and 12.5 grams of gelatin. After one minute the reaction temperature of this mixture was raised to 70° C. in 20 minutes and 47.5 grams of phthalated gelatin in 475 ml destilled water were added. After 10 minutes the neutralization step was started.

Neutralization step:

21.7 ml of solution 1 were added to the reaction vessel at a rate of 7.5 ml per minute to reach a pBr value of 1.63, whereafter the first growth step was started.

Growth step:

A double jet precipitation was started using solutions 1 and 2 which continued for 46 minutes and 51 seconds with a flowing rate for solution 1 at the start of 7.5 ml per minute linearly incrasing to 29.2 ml per minute at the end. Then the double jet precipitation continued using solutions 1 and 3 during 18 minutes with an initial flow rate of 29.2 ml per minute linearly increasing to 37.5 ml per minute at the end. During this growth step the pBr was kept constant at pBr=1.63.

Characteristics of the tabular grains:

average diameter: 1.60 μm coefficient of variation of the tabular grains: 0.30 average thickness: 0.12 μm.

aspect-ratio: 11 percentage of total projective surface: 98%.

Emulsion 2 (invention):

The nucleation and the first neutralization step are the same as those used to prepare the comparative emulsion, followed by a first growth step, a second neutralization step and a second growth step.

First growth step:

A double jet precipitation was started using solutions 1 and 2 which continued for 40 minutes 51 seconds. During this precipitation, the pBr value was kept constant at 1.63. The flowing rate of solution 1 was 7.5 ml per minute at the start, linearly increasing to 26.7 ml per minute at the end of the precipitation. Thereafter the second neutralisation phaze was started.

Second neutralization step:

45.8 ml of solution 1 was added at a rate of 7.5 ml per minute so that a pBr of 2.77 was obtained. The precipitation was then continued by a second growth step.

Second growth step (during which 47.0% of the total amount of $AgNO_3$ was used):

704 ml of solution 1 was injected in the reaction vessel at a rate of 7.5 ml per minute at the start linearly increasing to 37.5 ml per minute at the end of the precipitation. The pBr was kept constant at 2.77 using solution 2 for the first 8 minutes and 51 seconds, followed by the replacement of solution 2 by solution 3 for the rest of the precipitation.

The tabular grain emulsion 2, corresponding to this invention, had the following characteristics, measured with electron microscopic techniques:

average diameter: 1.26 μm coefficient of variation of the tabular grains: 0.37 average thickness: 0.15 μm aspect-ratio: 8.9 percentage of total projective surface: 99%.

Emulsion 3 (invention).

Nucleation step:

Equal to the comparison, except that 32.8 ml instead of 41.3 ml of solutions 1 and 2 were introduced into a reaction vessel in 28 seconds.

First neutralization step:

see comparative emulsion 1.

First growth step:

A double jet precipitation was started using solutions 1 and 2 which continued for 35 minutes and 22 seconds. During this precipitation, the pBr value was kept constant at 1.63. The initial flowing rate of solution 1 of 7.5 ml per minute at the start was linearly increased to 23.9 ml per minute at the end of the precipitation. Thereafter the second neutralization step was started.

Second neutralization step:

40.3 ml of solution 1 was added at a rate of 7.5 mi per minute so that a pBr of 2.77 was obtained. This neutralization step was followed by a second growth step.

Second growth step (consuming 57.3% of total amount of $AgNO_3$):

859.7 ml of solution 1 was injected in the reaction vessel at a rate of 7.5 ml per minute at the start linearly increasing to 37.5 ml per minute at the end of the precipitation. The pBr was kept constant at 2.77 using solution 2 for the first 17 minutes and 53 seconds followed by the replacement of solution 2 by solution 3 for the rest of the precipitation time.

Characteristics of the tabular grains:

average diameter: 1.37 μm coefficient of variation of the tabular grains: 0.33 average thickness: 0.17 μm aspect-ratio: 8.4 percentage of total projective surface: 98%.

Emulsion 4 (invention).

Nucleation step: see nucleation step to prepare emulsion 3.

Neutralization step: see comparative emulsion 1.

First growth step:

A double jet precipitation was started using solutions 1 and 2 which continued for 28 minutes and 39 seconds . During this precipitation, the pBr value was kept constant at a value of 1.63. The flowing rate of solution 1 was 7.5 ml per minute at the start, linearly increasing to 20.8 ml per minute at the end of the precipitation. Thereafter the second neutralisation step was started.

Second neutralization step:

37.5 ml of solution 1 was added at a rate of 7.5 nil per minute so that a pBr value of 2.77 was obtained. The precipitation was continued by a second growth step.

Second growth step (consuming 67.5% of the total amount of $AgNO_3$):

1012.5 ml of solution 1 was injected in the reaction vessel at an initial rate of 7.5 mi per minute and linearly increased to 37.5 mi per minute at the end of the precipitation. The pBr value was kept constant at 2.77 using solution 2 for the first 25 minutes and 41 second. Solution 2 was replaced by solution 3 for the rest of the precipitation time.

Characteristics of the tabular grains:

average diameter: 1.30 μm coefficient of variation of the tabular grains: 0.26 average thickness: 0.19 μm aspect-ratio : 7.0 percentage of total projective surface: 98%.

Washing and dispersing procedure.

After the emulsion precitation was ended the pH value was lowered to 3.5 with diluted sulphuric acid and the emulsion was washed using demineralized water of 11° C. At 45° C. 160 grams of gelatin were added and the values of pH and pAg at 40° C. were adjusted to 5.5 and 8.15.

Sensitization

Emulsions 1 to 4 were each optimally sulphur and gold sensitized in the presence of sodium thiocyanate and anhydro-5,5'-dichloro-3,3'-bis(n.sulfobutyl)-9-ethyloxacarbocyanine hydroxide Emulsion Coating.

Each emulsion was stabilized with 4-hydroxy-6-methyl-1, 3, 3α, 7-tetraazaindene and after addition of the normal coating additives the solutions were coated simultaneously together with a protective layer containing 1.1 g gelatine per $m^2$ per side on both sides of a polyethylene terephthalate

TABLE I

Speed, contrast after processing in a high and low activity developer.

| sample (emulsion number) | % AgNO3 consumed at pBr = 2.77 | average thickness | developer: high activity speed | high activity contrast | low activity speed | low activity contrast |
|---|---|---|---|---|---|---|
| 1 (comparison) | 0 | 0.12 | 100 | 3.70 | 68 | 2.89 |
| 2 (invention) | 47.0 | 0.15 | 100 | 3.67 | 79 | 2.97 |
| 3 (invention) | 57.3 | 0.17 | 100 | 3.73 | 83 | 3.13 |
| 4 (invention) | 67.5 | 0.19 | 102 | 3.74 | 87 | 3.37 |

film support having a thickness of 175 μm. The resulting photographic material contained per side an amount of silver halide corresponding to 3.5 grams of $AgNO_3$ per $m^2$.

Exposure, sensitometric and densitometric data:

Samples of these coatings were exposed with green light of 540 nm during 0.1 seconds using a continuous wedge and were processed during the 90 seconds cycle described below. The density as a function of the light dose was measured and therefrom were determined the following parameters:

fog level (with an accuracy of 0.001 density), the relative speed S at a density of 1 above fog (the sample with the comparative example was adjusted to a relative speed value of 100), the contrast, calculated between the densities 0.25 and 2.0 above fog.

The processing occurred in a glutaraldehyde containing hydroquinone/1-phenyl-3-pyrazolidinone developer marketed by Agfa-Gevaert N. V. under the trade name G138 having a high activity and in a cheap developer with a low activity having the composition described hereinafter.

Processing conditions and composition of developers.

processing machine: CURIX 402 (Agfa-Gevaert trade name) with the following time (in seconds (sec.)) and temperature (in ° C.) characteristics:

| | | |
|---|---|---|
| loading: | 3.4 | sec. |
| developing: | 23.4 | sec./35° C. high or low activity developer |
| cross-over: | 3.8 | sec. |
| fixing: | 15.7 | sec./35° C. in fixer AGFA G334 (trade name) |
| cross-over: | 3.8 | sec. |
| rinsing: | 15.7 | sec./20° C. |
| drying: | 32.2 | sec. (cross-over time included) |
| total time: | 98.0 | sec. |

Composition of the low activity developer (amounts given in grams/liter).

| | |
|---|---|
| hydroquinone | 13.3 |
| phenidone | 0.8 |
| sodiummetabisulphite | 29.7 |
| ethylenediamine tetraacetic acid, tetrasodium salt trihydrate | 1.33 |
| potassium hydroxyde | 27.9 |
| sodium tetraborate decahydrate | 8.8 |
| acetic acid | 5.2 |
| 5-methylbenzotriazole | 0.04 |
| 5-nitrobenzimidazole | 0.05 |
| glutardialdehyde | 3.0 |
| diethylene glycol | 12.8 |

Table I summarizes the speed and contrast of the samples after processing in the high and low activity developer.

This table shows that the samples obtain the same speed and a similar contrast in the high activity developer, but in the low activity developer the samples of the invention show a clearly higher speed and contrast. This result is unexpected because the tabular grains according to the invention are thicker than the tabular grains of the comparative example.

EXAMPLE 2

Precipition method and characterization of the tabular grains

Emulsion 5 (invention):

Nucleation step:

Same as for emulsion 2, except that 37.5 ml instead of 41.25 ml of solutions 1 and 2 were introduced into the reaction vessel in 28 seconds.

First neutralization step:

Same as for emulsion 2.

First growth step:

A double jet precipitation was started using solutions 1 and 2 which continued for 35 minutes. During this precipitation, the pBr value was kept constant at 1.63. The flowing rate of solution i initially was 7.5 ml per minute, linearly increasing to 24.0 ml per minute at the end of the precipitation, whereafter the second neutralisation step was started.

Second neutralization step: same as for emulsion 3.

Second growth step (consuming 57.2% of the total amount of $AgNO_3$):

857.5 ml of solution 1 was injected into the reaction vessel at a rate of 7.5 ml per minute at the start linearly increasing to 37.5 ml per minute at the end of the precipitation. The pBr value was kept constant at 2.77 using solution 2 for the first 17 minutes and 46 seconds and replacing it by solution 3 for the rest of the precipitation time.

Characteristics of the tabular grains:

average diameter: 1.25 μm coefficient of variation of the tabular grains: 0.34 average thickness: 0.17 μm aspect-ratio: 7.84 percentage of total projective surface: 97%.

Emulsion 6 (invention):

Nucleation step: same as for emulsion 5.

First neutralization step:

9.3 ml of solution 2 were added to the reaction vessel at a rate of 7.5 ml per minute so that a pBr value of 1.34 was measured. The first growth step was then started.

First growth step:

A double jet precipitation was started using solutions 1 and 2 which continued for 36 minutes 44 seconds. During this precipitation step, the pBr value was kept constant at 1.34. The flowing rate of solution 1 was 7.5 ml per minute at the start, linearly increasing to 24.2 ml per minute at the end of the precipitation. Thereafter the second neutralization step was started.

Second neutralization step:

88.0 ml of solution i was added at a rate of 7.5 ml per minute so that a pBr of 2.77 was obtained. The precipitation was followed a second growth step.

Second growth step (consuming 54.1% of total amount of $AgNO_3$):

822.8 ml of solution 1 was injected into the reaction vessel at a rate of 7.5 ml per minute at the start linearly increasing to 37.5 ml per minute at the end of the precipitation. The pBr value was kept constant at 2.77 using solution 2 for the first 15 minutes and 18 seconds and then solution 2 was changed by solution 3 for the rest of the precipitation time.

Characteristics of the tabular grains:

average diameter: 1.27 μm coefficient of variation of the tabular grains: 0.40 average thickness: 0.16 μm aspect-ratio: 8.2 percentage of total projective surface: 98%.

Emulsion 7 (invention)

Nucleation step, first neutralization step, first growth step: same as for emulsion 5.

Second neutralization step:

90.8 ml of solution 1 was added at a rate of 7.5 ml per minute so that a pBr value of 3.5 was obtained. The precipitation was then continued by second growth step.

Second growth step (consuming 53.9% of the total amount of $AgNO_3$):

809.2 ml of solution 1 was injected into the reaction vessel at a rate of 7.5 ml per minute at the start linearly increasing to 37.5 ml per minute at the end of the precipitation. The pBr value was kept constant at 3.5 using solution 2 for the first 15 minutes and 49 seconds followed by the replacement of solution 2 by solution 3 for the rest of the precipitation time.

Characteristics of the tabular grains:

average diameter: 1.15 μm coefficient of variation of the tabular grains: 0.35 average thickness: 0.28 aspect-ratio: 5.2 percentage of total projective surface: 95%.

Washing, dispering, sensitization, coating and photographic tests were performed as in example 1.

In Table II the photographic results of emulsions 5 to 8 and of the comparative emulsion 1 are summarized. The speed after processing in the high and the low activity developer are given and also the ratio between those speeds. A ratio close to 1 indicates that the corresponding sample is only slightly dependent of the processing condition.

TABLE II

Speed, contrast after processing in a high and low activity developer for emulsions 5 to 8.

| sample with emulsion number | pBr first growth step | pBr second growth step | % AgNO3 consumed at pBr > 2.7 | speed[1] high | speed[1] low | speedratio[2] |
|---|---|---|---|---|---|---|
| 1 (comp. ex.) | 1.63 | — | 0 | 100 | 73 | 1.37 |
| 5 (invention) | 1.63 | 2.77 | 57.2 | 100 | 81 | 1.23 |
| 6 (invention) | 1.34 | 2.77 | 54.1 | 117 | 98 | 1.20 |
| 7 (invention) | 1.63 | 3.50 | 57.0 | 100 | 79 | 1.26 |
| 8 (invention) | 1.34 | 3.50 | 53.9 | 117 | 100 | 1.17 |

speed[1] high: speed after processing in the high activity developer
speed[1] low: speed after processing in the low activity developer.
speedratio[2]: ratio of speed[1] high over speed[1] low.

45.2 ml of solution 1 was added at a rate of 7.5 ml per minute so that a pBr value of 3.5 was obtained. The precipitation was followed by a second growth step.

Second growth step (in this step 57% of total amount of $AgNO_3$ was consumed):

854.8 ml of solution 1 was injected in the reaction vessel at a rate of 7.5 ml per minute at the start linearly increasing to 37.5 ml per minute at the end of the precipitation. The pBr value was kept constant at 3.5 using solution 2 for the first 17 minutes and 37 seconds, followed by the replacement of solution 2 by solution 3 for the rest of the precipitation time.

Characteristics of the tabular grains:

average diameter: 1.13 μm coefficient of variation of the tabular grains: 0.26 average thickness: 0.29 μm aspect-ratio: 3.9 percentage of total projective surface: 98%.

Emulsion 8:

Nucleation step, first neutralization step, first growth step: same as for emulsion 6.

Second neutralization step:

Table II shows that this speed ratio is clearly lower for the emulsions according to the invention than for the comparative emulsion 1. It is also demonstrated that the pBr value of the first and the second growth step can be varied within large margins without loosing said effect on developability obtained in this invention.

We claim:

1. Method for the preparation of an emulsion with silver halide grains, wherein at least 70% of the total projected area of all the grains is provided by tabular grains, and wherein said tabular grains exhibit an average aspect ratio of at least 2:1 an average thickness between 0.15 and 0.30 μm, a coefficient of variation of the tabular grains between 0.15 and 0.45, said method comprising the following steps:

preparing a dispersion medium containing a gelatino-peptizer and being adjusted to a pBr value between 1.0 and 2.0 by means of a bromide ions providing salt a crystal nucleation step consuming less than 10% by weight of the total amount of silver nitrate used a first double jet crystal growth step wherein at least 10% of the total amount of silver nitrate is precipitated at a constant pBr value between 1.0 and 2.5, and a second double jet crystal growth step wherein at least 40% of the total amount of the silver nitrate used is added at a constant pBr value higher than 2.7.

2. Method according to claim 1, wherein no ammonia (intentionally added or generated in situ is used during the nucleation step or the growth step(s) in the preparation of said silver halide tabular grains.

3. Method according to claim 1, wherein the pBr value is situated between 1.3 and 2.0 during the nucleation step to form hexagonal or circular tabular grains.

4. Method according to claim 1, wherein the coefficient of variation of the tabular grains is between 0.20 and 0.45.

5. Method according to claim 1, wherein the coefficient of variation of the tabular grains is between 0.30 and 0.45.

6. Method according to claim 1, wherein the average thickness of the tabular grains is between 0.20 and 0.30 μm.

7. Method according to claim 1, wherein the average aspect ratio of the tabular grains is less than 8.0.

8. Method according to claim 1, wherein the average aspect ratio of the tabular grains is less than 5.0.

9. Method according to claim 1, wherein the silver halide emulsion crystals are silver bromoiodide crystals with amounts of iodide ions of up to 3 mole %.

10. Photographic material comprising a support and at least one silver halide emulsion layer on at least one side of said support coated from an emulsion containing tabular silver halide emulsion grains prepared according to the method of claim 1.

11. Photographic material according to claim 10, wherein said photographic material is a single or double side coated X-ray material.

* * * * *